United States Patent [19]

Bouton

[11] Patent Number: 4,732,274

[45] Date of Patent: Mar. 22, 1988

[54] PORTABLE TRAY TABLE

[76] Inventor: James A. Bouton, 6 Myron Ct., Teaneck, N.J. 07666

[21] Appl. No.: 930,084

[22] Filed: Nov. 13, 1986

Related U.S. Application Data

[63] Continuation of Ser. No. 753,520, Jul. 10, 1985, abandoned.

[51] Int. Cl.[4] ..... B65D 73/00

[52] U.S. Cl. ..... 206/561; 206/562; 206/557; 206/1.7; 220/23.83; 220/23.8

[58] Field of Search ..... 206/587, 561, 562, 563, 206/564, 1.7; 220/13.83, 13.8

[56] References Cited

U.S. PATENT DOCUMENTS

| | | | |
|---|---|---|---|
| 748,026 | 12/1903 | Sussmilch | 206/1.7 |
| 1,757,689 | 5/1930 | Strickland | 206/562 |
| 2,546,104 | 3/1951 | MacGregor | 220/23.8 |
| 2,738,606 | 8/1956 | Klein | 206/1.7 |
| 3,094,264 | 6/1963 | Petrone | 206/562 |
| 3,201,024 | 8/1965 | Brokop | 206/562 |
| 3,504,832 | 4/1970 | Corvetti | 206/557 |
| 3,738,251 | 6/1973 | Haaser | 206/557 |
| 3,942,671 | 3/1976 | Florian | 220/23.8 |
| 3,955,672 | 5/1976 | Brundage | 206/562 |
| 4,291,805 | 9/1981 | Seeley | 206/563 |
| 4,314,650 | 2/1982 | Cillario | 206/562 |

FOREIGN PATENT DOCUMENTS

| | | | |
|---|---|---|---|
| 2078493 | 6/1982 | United Kingdom | 220/23.8 |

*Primary Examiner*—Joseph Man-Fu Moy
*Attorney, Agent, or Firm*—Blum Kaplan

[57] ABSTRACT

A portable tray table having an upper surface for supporting food, a lower surface and a peripheral edge. A skirt is coupled to the peripheral edge of the panel and extends downwardly therefrom. The panel includes an opening therein wit a cup holder supported on the panel about the opening which extends downwardly therefrom. The skirt includes at least one cut-out portion which exposes the cup holder to permit a user to insert a hand through the cut-out portion to grasp the cup holder.

11 Claims, 6 Drawing Figures

PORTABLE TRAY TABLE

This is a continuation of application Ser. No. 753,520, filed July 10, 1985, now abandoned.

BACKGROUND OF THE INVENTION

The present invention is directed generally to a portable tray table and, in particular, to a tray table preferably formed from a rigid paper material such as cardboard which can support both food and a beverage and which can be readily carried by one hand.

With the interest in paper plates and other disposable food carriers, it is not surprising that a number of patents over the years have been directed to trays and other types of food carriers. Examples of such prior art constructions are found in U.S. Pat. Nos. 2,240,020, 2,352,684, 2,771,232, 2,837,388, 3,025,948, 3,315,858, 3,392,874, 3,883,029, 3,955,672, and 4,291,805.

It is desirable particularly for use at ballgames, picnics, parties and like events to have a disposable tray table which can support both food and a beverage contained in a cup. Of the above-identified patents, U.S. Pat. Nos. 2,240,020, 3,883,029 and 3,955,672 are directed to trays or plates which includes means for supporting or holding a cup.

It would be particularly desirable if such a tray table could be designed which includes a surface for supporting food and means for supporting a cup which can be supported on a person's lap, tabletop or other such surface and which can be readily carried by one hand of a user to permit the other hand to be used for consuming the food and beverage supported on the tray table. None of the above-identified patents offer such a combination of features. Accordingly, it is desirable to provide an improved portable tray table including each of the benefits and advantages noted above.

SUMMARY OF THE INVENTION

Generally speaking, in accordance with the present invention, a portable tray table which is capable of supporting both food and a cup containing a beverage, is provided. The portable tray table includes a panel having an upper surface for supporting food, a lower surface and a peripheral edge. A skirt is coupled to the peripheral edge of the panel and extends downwardly therefrom. The panel includes an opening therein. A cup holder is supported on the panel about the opening and extends downwardly therefrom. The skirt includes at least one cut-out portion exposing the cup holder to permit a user to insert a hand through the cut-out portion and grasp the cup holder.

In a preferred embodiment, the portable tray table is made from a rigid material such as paper, styrofoam or the like. The height of the skirt is preferably greater than the length of the cup holder to permit the tray table to rest securely on a surface. Divider ribs may be provided on the upper surface of the panel to divide the panel into separate compartments for supporting different types of food. Such a construction can be readily manufactured and will be inexpensive.

Accordingly, it is an object of the present invention to provide a portable tray table which can be readily carried by one hand of a user, thereby freeing the other hand for other purposes such as eating the food and drinking the beverage contained thereon.

Another object of the present invention is to provide a portable tray table which can be readily lifted off of a surface with only one hand.

A further object of the present invention is to provide an improved portable tray table capable of supporting both food and a cup containing a beverage.

A still further object of the present invention is to provide an improved portable tray table.

A still further object of the present invention is to provide an improved portable tray table which is disposable.

Yet another object of the present invention is to provide an improved tray table which is easy to manufacture and inexpensive in cost.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
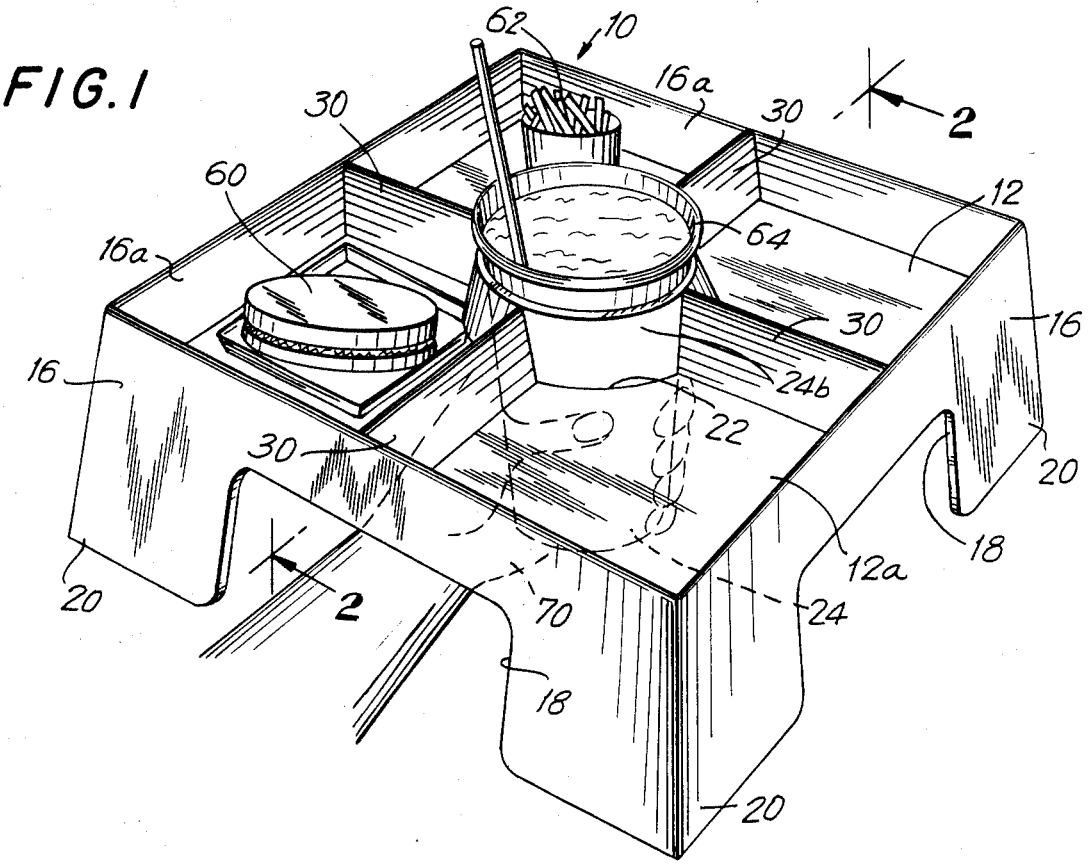
FIG. 1 is a perspective view of a portable tray table constructed in accordance with a preferred embodiment of the present invention.
Figure 2:
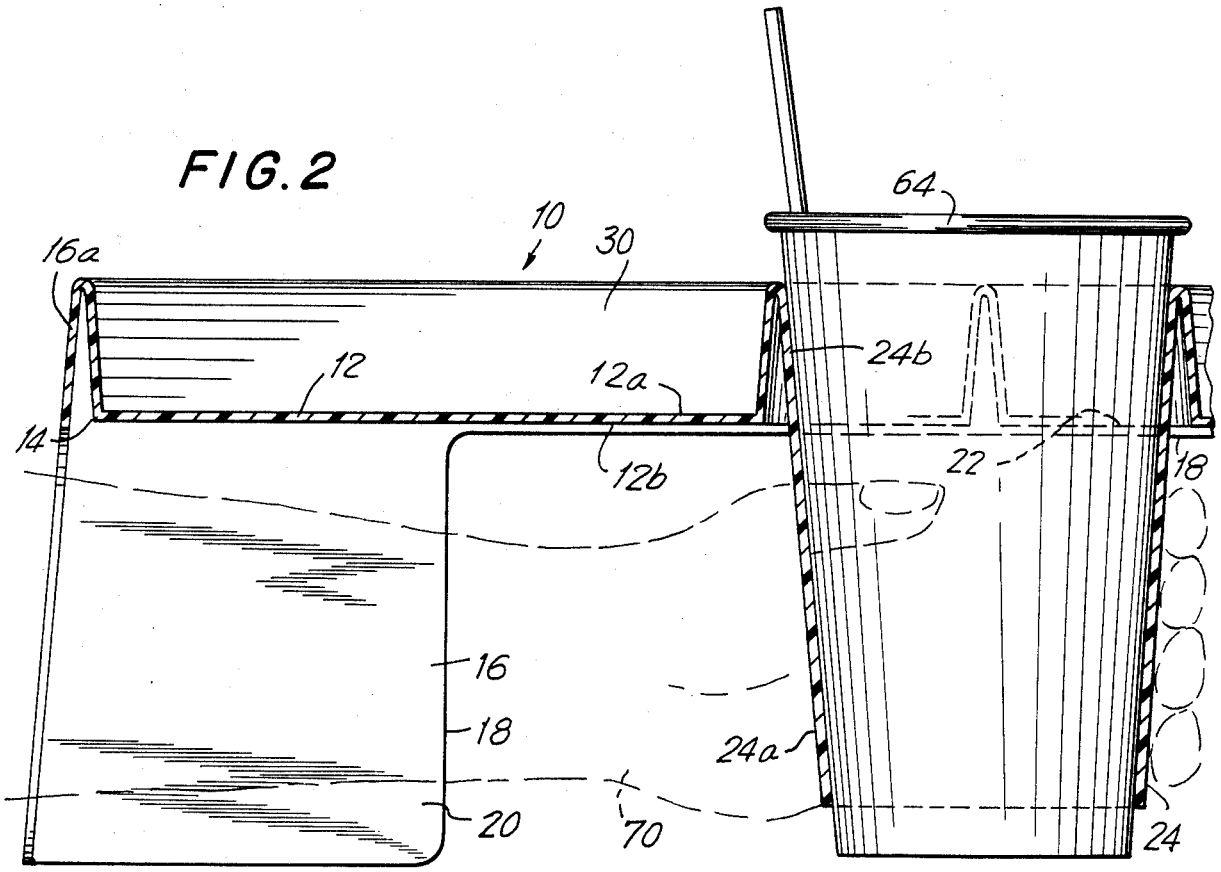
FIG. 2 is an enlarged sectional view taken along line 2—2 of FIG. 1.
Figure 3:
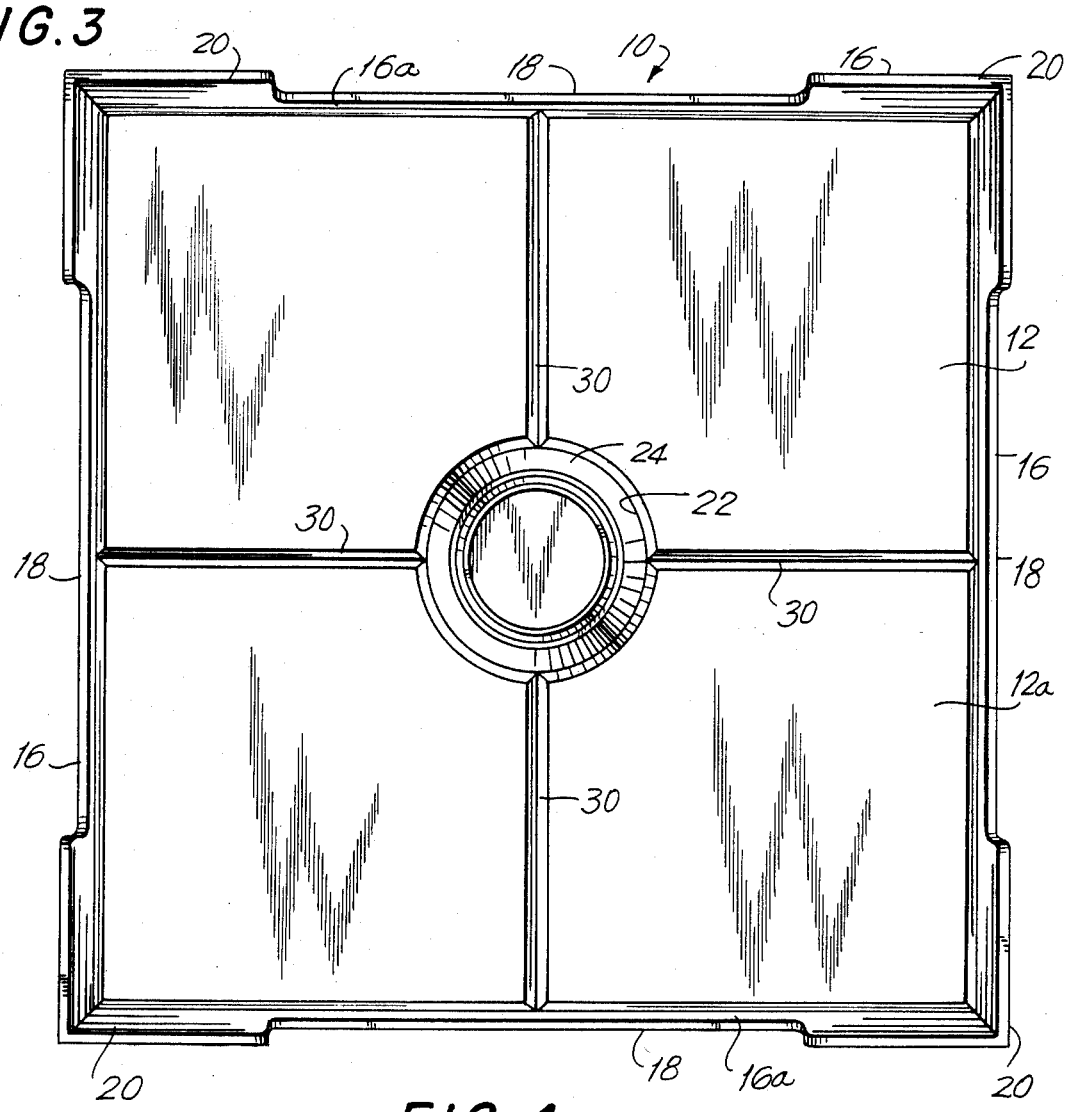
FIG. 3 is an enlarged top plan view of the tray table depicted in FIG. 1.

Reference is first made to FIGS. 1 through 3 which depict a portable tray table, generally indicated at 10, constructed in accordance with a preferred embodiment of the present invention. Tray 10 includes a panel 12 which includes an upper surface **12*a* and a lower surface 12*b*. A peripheral edge 14 extends around the outer boundary of panel 12. A skirt 16 is coupled to and extends downwardly from peripheral portion 14 of panel 12. A portion 16a of skirt 16 may extend above upper surface 12*a* of panel 12. Skirt 16 acts as the supporting structure for tray table 10** on a surface.

Cut-out portions 18 are formed along skirt 16. As depicted in FIGS. 1 through 3, since tray table 10 is rectangular or square, a cut-out 18 is formed in each of the four sides thereof. It is noted that for the purposes of the present invention, only one cut-out portion 18 is required. With cut-out portions 18, skit 16 essentially defines four legs 20, each of which is respectively formed at the four corners of table 10.

An opening 22 is formed in a central portion of panel 12. A cup holder 24 is supported on panel 12 and extends through opening 22. Cup holder 24 includes a portion **24*a* which extends downward from panel 12 and a second portion 24*b* which extends above panel 12**.

The height of lower portion 24a of cup holder 24 is shorter than the height of skirt 16 so that when tray 10 is supported on a surface, cup holder 24 will not interfere. Cup holder 24 includes top and bottom open ends and is in the form of a truncated cone to correspond to the configuration of most beverage cups and glasses.

Several divider ribs 30 may be provided on upper surface 12a of panel 12 to divide panel 12 into several different compartments for holding different types of food. Ribs 30 would also act to enhance the stability of table 10. In the embodiment of FIGS. 1 through 3, divider ribs 30 extend from upper portion 16a of skirt 16 radially to upper surface 24b of cup holder 24. As depicted in FIG. 1, a sandwich 60 may be supported in one compartment and french fries 62 may be supported in a second compartment. The other compartments may be used for other food items. A cup 64 is supported in cup holder 24.

As depicted, skirt 16 preferably opens downwardly and away from panel 12. With this construction, a plurality of tray tables 10 can be readily nested one on top of the other to reduce shipping and storage space.

Figure 4:
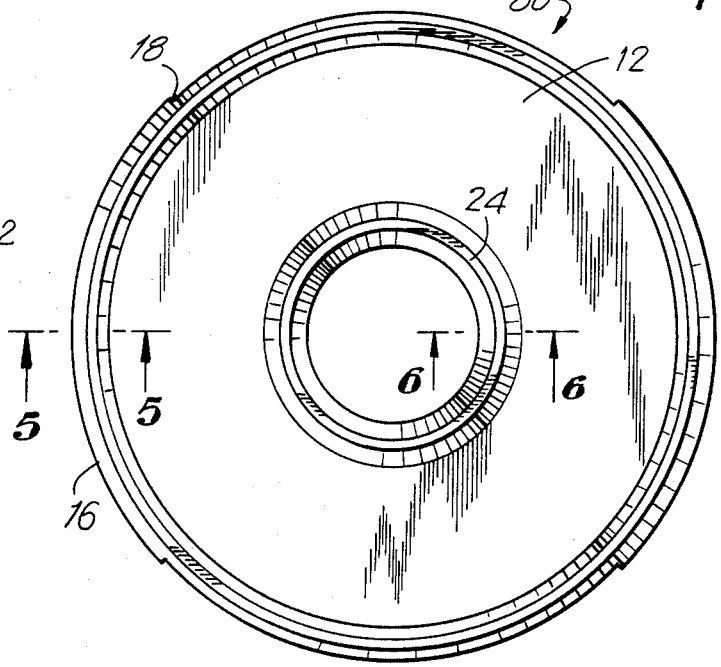
FIG. 4 is a top plan view of a portable tray table constructed in accordance with an alternative embodiment of the present invention.
Figure 5:
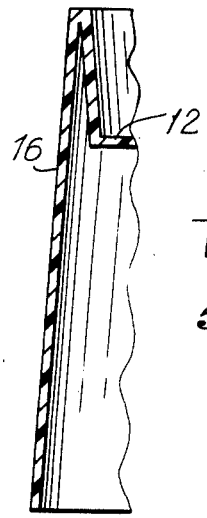
FIG. 5 is a sectional view taken along line 5—5 of FIG. 4.
Figure 6:
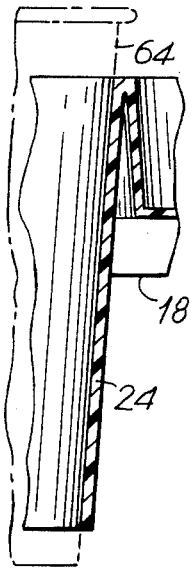
FIG. 6 is a sectional view taken along line 6—6 of FIG. 4.

Portable tray table 10 is preferably constructed from a rigid material such as paper, cardboard, styrofoam or the like so as to be readily and inexpensively manufactured and to permit table 10 to be discarded after use. It is noted, however, that tray table 10 can be made of any other suitable rigid material. Cut-out 18 permits a hand 70 of a user to be inserted through cut-out 18 so as to allow grasping of cup holder 24 as depicted in FIGS. 1 and 2. In this fashion, table can be readily supported by one hand of a user thereby permitting other hand to be used in connection with the consumption of the food and beverage supported thereon. Thus, the present invention provides a neat and inexpensive way of carrying food and beverage from a food concession at a ball park or from a buffet table at a party, while enabling the person utilizing such portable tray table to place the tray on a lap while sitting or to carry the table with one hand, thereby freeing the other hand for other purposes such as in connection with consumption FIGS. 4 through 6 depict an alternative embodiment of the present invention wherein a tray table generally indicated at 80 is circular rather than rectangular as depicted in FIGS. 1 through 3. Moreover, no dividing ribs 30 are utilized in the construction depicted in FIGS. 4 through 6. All of the remaining elements are the same and have been numbered accordingly including panel 12, skirt 16, cup holder 24, and cut-out portion 18. It is noted that other shapes and configurations are possible and the present invention should not be construed as limited to only the rectangular and circular shapes depicted.

The present invention provides an improved portable tray table which accomplishes each of the benefits and advantages noted above. The table is readily portable and can be supported by only one hand. The table is disposable, easy and inexpensive to manufacture.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A portable tray table formed from a rigid material comprising a panel having an upper food bearing surface extending in a substantially horizontal direction and including a peripheral edge, a skirt coupled to said peripheral edge of said panel and extending downwardly therefrom, said skirt having a lower edge forming a support for supporting said panel above a horizontal surface when said portable tray table is resting on said horizontal surface, said panel having an opening in said food bearing surface located in a central portion thereof, a cup holder supported on said panel and extending downwardly through said opening, said cup holder having a sufficient length forming a gripable surface to be gripped by the fingers and palm of the hand of a user, said skirt including at least one cut-out portion whereby said gripable surface of said cup holder is accessible through said cut-out portion when said portable tray table is supported on said horizontal surface, said cut-out portion being sized to form a substantial opening in said skirt between said support formed on the lower edge of said skirt and said peripheral edge of said panel, said cut-out portion permitting the hand of a user to be inserted through said cut-out portion to grasp said gripable surface of said cup holder when said portable tray table is supported on said horizontal surface.

2. The portable tray table as claimed in claim 1, wherein said cup holder is in the form of a truncated cone.

3. The portable tray table as claimed in claim 1, wherein the portion of said cup holder extending below said lower surface of said panel is shorter than the height of said skirt.

4. The portable tray table as claimed in claim 1, wherein said skirt opens outwardly to permit nesting of said tray table with other similar tray tables.

5. The portable tray table as claimed in claim 4, wherein said panel is rectangular, said skirt including a cut-out portion on each side thereof.

6. The portable tray table as claimed in claim 1, wherein said panel, skirt and cup holder are formed from a rigid material.

7. The portable tray table as claimed in claim 6, wherein said material is selected from the group consisting of paper, cardboard and styrofoam.

8. The tray table as claimed in claim 1, wherein said upper surface of said panel includes divider means for dividing said upper surface into compartments, said skirt including a portion which extends above said upper surface of said panel.

9. The portable tray table as claimed in claim 8 wherein a portion of said cup holder extends above said upper surface of said panel through said opening.

10. The portable tray table as claimed in claim 9, wherein said divider means include a plurality of ribs which extend radially from said portion of said cup holder which extends above said upper surface.

11. The portable tray table as claimed in claim 4, wherein said panel is circular.

* * * * *